United States Patent [19]

Nichimoto et al.

[11] 4,323,148

[45] Apr. 6, 1982

[54] COIN SELECTOR FOR VENDING MACHINE

[75] Inventors: Susumu Nichimoto, Tenri; Isao Shinoda, Ikoma; Shigeo Nakamura; Haruhide Tsumura, both of Hirakata, all of Japan

[73] Assignee: Matsushita Electric Industrial Co., Ltd., Osaka, Japan

[21] Appl. No.: 127,421

[22] Filed: Mar. 5, 1980

[30] Foreign Application Priority Data

| | | | |
|---|---|---|---|
| Mar. 12, 1979 | [JP] | Japan | 54-29158 |
| Jul. 9, 1979 | [JP] | Japan | 54-86770 |
| Jul. 9, 1979 | [JP] | Japan | 54-86791 |

[51] Int. Cl.[3] ..... G07F 3/02

[52] U.S. Cl. ..... 194/100 A; 194/102; 324/229

[58] Field of Search ..... 194/97 R, 100 R, 100 A, 194/99, 102; 324/229

[56] References Cited

U.S. PATENT DOCUMENTS

| | | | |
|---|---|---|---|
| 2,146,442 | 2/1939 | Price | 324/229 |
| 2,982,389 | 5/1961 | Dietrich | 194/97 R |
| 3,918,564 | 11/1975 | Heiman et al. | 194/100 A |
| 3,998,309 | 12/1976 | Mandas et al. | 194/97 R |
| 4,006,405 | 2/1977 | Greenwood et al. | 324/229 X |
| 4,108,296 | 8/1978 | Hayashi et al. | 194/99 |
| 4,184,366 | 1/1980 | Butler | 194/102 X |

FOREIGN PATENT DOCUMENTS 48-14397 2/1973 Japan .

*Primary Examiner*—Joseph J. Rolla
*Attorney, Agent, or Firm*—Spencer & Kaye

[57] ABSTRACT

A coin selector apparatus of the electronic type for a vending machine into which a coin thrown in the selector is moved through electromagnetic fields each produced by a coil assembly constituting a part of an oscillator oscillating at a predetermined frequency. Variations in the output oscillation frequencies of the oscillators are detected and utilized for discriminating between coins with respect to their shape, material and thickness.

Further, a selected oil assembly is provided with a coil gap that is changeable in association with the closing and opening of the coin passage to cause a variation in the corresponding output oscillation frequency and to produce a coin rejection signal.

6 Claims, 15 Drawing Figures

15
16
17
18
19
20
21
22
23
24
25
26
C1
R1
7a
C3
D
C2
C4
Tr
R2
R3
L
R4
9a
9b
8a
8b
10a
COUNTER
MICRO-COMPUTER CONTROL
OUTPUT CIRCUIT
THRESHOLD VALUE SETTING CIRCUIT

COIN SELECTOR FOR VENDING MACHINE

The present invention relates to a coin selector apparatus for an automatic vending machine. In particular, the invention concerns an electronic type coin selector apparatus in which selection or discrimination of inserted coins is effected by detecting variations in the oscillation frequencies of oscillators, which variations are brought about by the coins moving through electromagnetic fields produced by coil assemblies each constituting a part of one of the oscillators.

Heretofore, coin selector apparatus of the electronic type described above have been widely adopted for use in automatic vending machines in view of the fact that discrimination of coins can be attained with a high degree of accuracy. For the electronic type coin selector apparatus, there have been proposed for practical purposes and applications various arrangements including one in which an electromagnetic field having a low frequency is combined with another electromagnetic field having a very high frequency for effecting the selection or discrimination of coins. In another arrangement, a differential transformer is employed in place of the coil constituting a part of an oscillator, variations in the output appearing across the secondary winding of the transformer being detected in order to identify the coin.

Although electronic type coin selector apparatuses of the prior art are capable of discriminating true or authorized coins from counterfeited false or inhibited ones with a high accuracy and reliability as compared with the hitherto known mechanical types of coin selectors, there is a demand for a coin selector which allows the discriminatory selection of the coins to be performed with a much enhanced accuracy and reliability.

The electronic type coin selector apparatus is very advantageous in that the coin selection can be made in a contactless manner and thus the selector can be implemented with a greatly simplified structure which does not require the disposition of obstacles to movement of the coins in the coin path. However, there are disadvantages to these devices in that the coin once inserted in the selector can be easily withdrawn by means of a length of thread attached to the coin, and a true coin reception signal may be produced in spite of the fact that no coin has been actually accepted, thereby producing an erroneous count.

In the coin selector, there is provided a coin classifying unit adapted to classify the accepted true coins into groups in dependence on the types of coins. Such a coin classifying unit includes a gate member which is opened by the authorized coin reception signal. Accordingly, when the gate member is not properly operated, even a coin which has been determined to be a true or authorized one will be disadvantageously rejected.

Accordingly, an object of the invention is to provide an electronic type coin selector apparatus for vending machines which can be operated with a much enhanced accuracy and reliability and which can be implemented inexpensively in a simplified configuration.

FIGS. 2A, 2B to 6 are schematic sectional views showing structures of the individual sensors, respectively;

Now, a coin selector apparatus according to an embodiment of the invention will be described by referring to the accompanying drawings.

Figure 1:
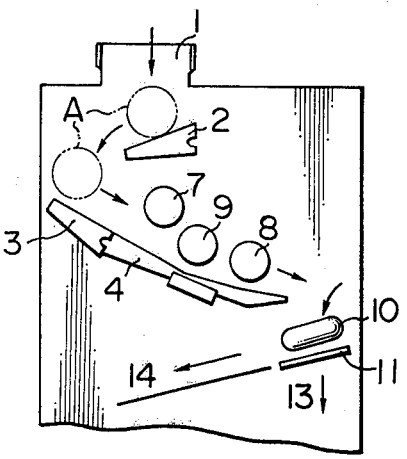
FIG. 1 shows schematically an arrangement of individual sensors in a coin selector apparatus according to an embodiment of the invention.
Figure 2A:
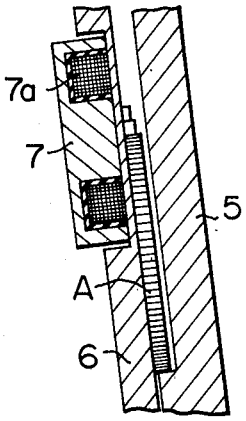

In FIG. 1 which shows schematically an arrangement of various sensors employed in the coin selector apparatus according to the invention, reference numeral 1 denotes a coin inlet slot through which a coin A is inserted into the selector apparatus, 2 designates a first snubber member for absorbing kinetic energy of the dropping coin A inserted in the inlet slot 1, 3 denotes a second snubber member provided for the same purpose as the first snubber 2, and numeral 4 designates a ramp disposed in succession to the second snubber member 3 and adapted to guide the coin A rolling downwardly therealong. As will be seen from FIGS. 2 to 4, the ramp 4 is composed of a deck 5 and a lid member 6, which are so arranged that the coin A rolling down along the ramp 4 is inclined toward the lid member 6.

Figure 3:
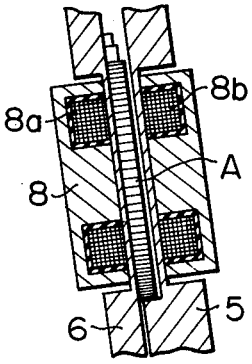

Reference numeral 7 denotes a coin shaper sensor for detecting the geometrical configuration or shape of the coin A. The coin shape sensor 7 is composed of a single coil 7*a* disposed on the lid member 6 in a manner shown in FIG. 2A. The coil 7*a* is connected so as to constitute a part of an oscillator circuit (described hereinafter) which is adapted to oscillate at a predetermined frequency, e.g. at about 450 KHz in the absence of coil A, thereby producing an electromagnetic field. Numeral 8 denotes a coin thickness sensor which is constituted by a pair of coils 8*a* and 8*b* mounted on the deck 5 and the lid member 6, respectively, in opposition to each other across the path of the coin A, as is shown in FIG. 3. Both the coils 8*a* and 8*b* are connected also in an oscillator circuit (described hereinafter) which is adapted to oscillate at a predetermined frequency, e.g. about 750 KHz to produce an electromagnetic field in the case of the absence of the coin A on the ramp 4 at a location defined by the paired sensor coils 8*a* and 8*b*.

Figure 4A:
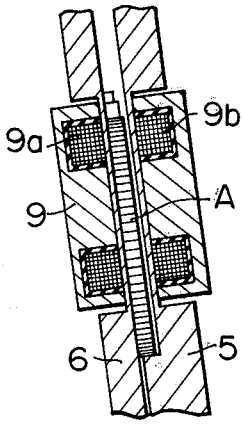

Reference numeral 9 denotes a coin material sensor which is constituted by a pair of coils 9*a* and 9*b* mounted on the deck 5 and the lid member 6, respectively, in opposition to each other across the coin passage in a manner similar to that in which the coin thickness sensor 8 is mounted. Reference is made to FIG. 4A. The pair of material sensor coils 9*a* and 9*b* are also connected in an oscillator circuit (described hereinafter) which is adapted to oscillate at a predetermined frequency in the vicinity of 200 KHz to generate an electromagnetic field in the case where no coin A is present at a location defined between the coin material sensior coils 9*a* and 9*b*. In this connection, it is to be noted that the coin shape sensor 7, the coin thickness sensor 8 and the coin material sensor 9 are arranged successively along the coin path in this order as viewed in the moving direction of the coin A. Additionally, the coin shape sensor 7 is disposed at a location where the shapes of coins to be selected can be best discriminated. When passing through the shape sensor 7, the coin A is caused to be brought into close contact with the shape sensor 7. On the other hand, the coin thickness sensor 8 as well as the coin material sensor 9 are disposed at respective locations at which differences in the shape of coins A exert little influence on the sensitivity of these sensors 8 and 9.

Figure 2B:
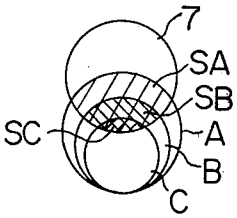
Figure 4B:
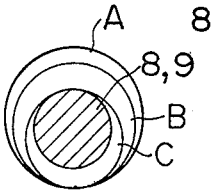

FIG. 2B shows the physical relationship between the shape sensor 7 and different size coins A, B and C having respective maximum area SA, SB and SC overlapping the shape sensor, sensor 7 being located at a position which results in remarkable differences between the maximum areas. This location of the shape sensor causes large differences between a difference frequency $\Delta f$ (mentioned later) for the coins A, B and C. FIG. 4B shows the physical relationship between the thickness or material sensor which are located at positions where they completely overlap the coins A, B or C so as to sense little difference between the coin areas which overlap the sensor. This location of the sensors is due to the fact that the thickness or material is discriminated by detecting difference in the difference frequency $\Delta f$ which is caused by a difference in the permeability of the coin due to a difference in the coin thickness or material.

The lid member 6 is pivotally mounted on the deck 5 so as to be rotatably displaced with a predetermined angle, so that the coin as inserted can be diverted to a coin return port when the coin passage is opened by rotating the lid member 6.

Figure 5:
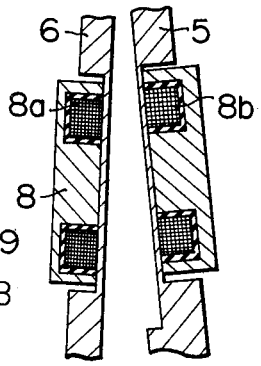

FIG. 5 shows the state in which the lid member 6 is angularly displaced to open the coin passage for rejecting the inserted coin. It will be appreciated that the span between the coils 8*a* and 8*b* of the coin thickness sensor 8 is enlarged in the state shown in FIG. 5.

Reference numeral 10 denotes a coin passage sensor for detecting the passage of the coin A. This sensor 10 is composed of a coil 10*a* which is mounted on the deck 5 and connected so as to constitute a part of an oscillator circuit adapted to oscillate at a predetermined frequency in the vicinity of 600 KHz to produce an electromagnetic field, when the coin A is not in front of the coil 10*a*.

Figure 6:
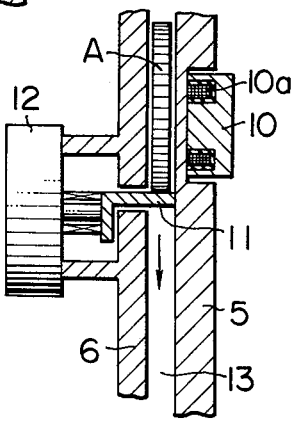

Numeral 11 denotes a gate member for classifying coins A accepted as authorized or true coins in dependence on the types of coins. As can be seen from FIG. 6, the gate member 11 is adapted to be actuated by a solenoid device 12 to be opened so that the coin A is fed to a true coin receiving passage 13. On the other hand, when the gate member 11 is in the closed state, the coin A is diverted to a coin rejecting passage 14. In other words, the gate member 11 serves as switching means for changing over the coin path between the coin accepting passage 13 and the coin rejecting passage 14. It will be noted that the coin passage sensor 10 is disposed above the gate member 11.

Next, description will be made of an electric circuit arrangement and operation of the coin selector apparatus according to the invention.

Figure 7:
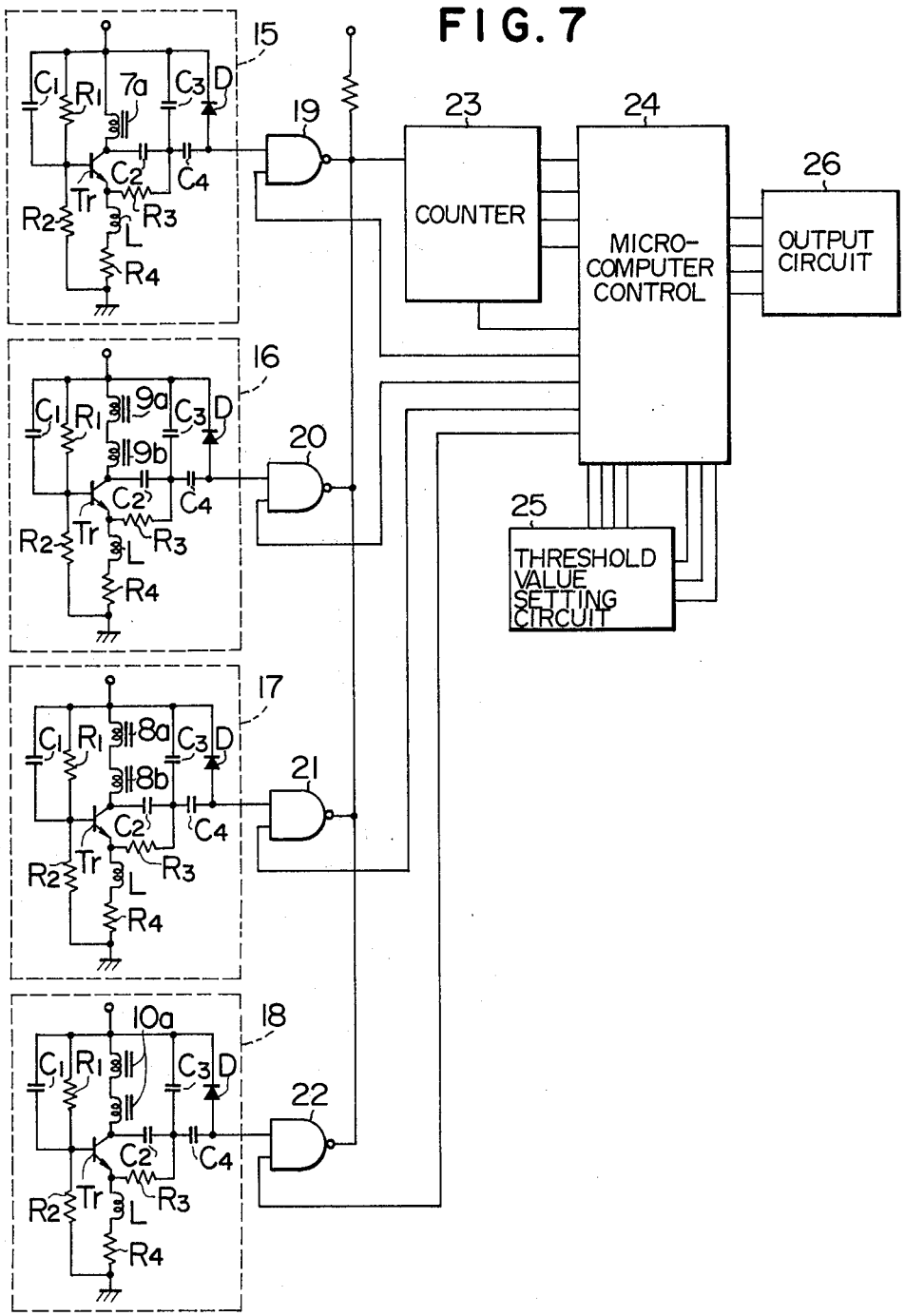
FIG. 7 is a circuit diagram depicting an electric circuit employed in a coin selector apparatus according to the invention.

Referring to FIG. 7, numerals 15, 16, 17 and 18 denote the LC-oscillator circuits in which the coils 7*a* of the coin shape sensor 7, the paired coils 9*a*; 9*b* of the coin material sensor 9, the paired coils 8*a*; 8*b* of the coin thickness sensor 8 and the coil 10*a* of the coin passage sensor 10 are connected, respectively. These LC-oscillator circuits 15, 16, 17 and 18 are implemented in completely identical circuit configurations, each being constituted by a transistor Tr, a diode D, resistors $R_1$, $R_2$, $R_3$ and $R_4$, capacitors $C_1$, $C_2$, $C_3$ and $C_4$, and a peaking coil L.

In FIG. 7, numerals 19, 20, 21 and 22 denote gate circuits, 23 denotes a counter circuits, 24 denotes a control circuit constituted by a micro-computer and, 25 denotes a threshold value setting circuit. The gate circuits 19, 20, 21 and 22, the counter circuit 23, the control circuit 24 and the threshold value setting circuit 25 constitute together a coin discriminator unit.

Reference numeral 26 denotes an output circuit. The gate circuits 19, 20, 21 and 22 are opened (i.e. made conductive) by an enabling signal produced by the control circuit 24, while the counter circuit 23 is adapted to be set and reset by respective signals available from the control circuit 24. When no coin is moving toward the coin shape sensor 7, the coin thickness sensor 8, the coin material sensor 9 or the coin passage sensor 10, the oscillator circuits 15, 16, 17 and 18 produce respective idle frequencies $f_o$ each of which is determined by the self-inductance and mutual inductance of the associated sensor coil or coils and values of the capacitors $C_2$ and $C_3$. On the other hand, when a coin A of an electrically conductive material approaches the sensor 7, 8, 9 or 10, the associated oscillator circuits 15, 16, 17 or 18 will produce respective output signals at respective oscillation frequencies $f_1$ each of which depends on the shape, the material and the thickness of the approaching coin and is higher than the respective idle frequency $f_o$ described hereinbefore. The control circuit 24 serves to determine whether the inserted coin A is a true coin with respect to its shape, material and thickness and whether the coin has been accepted by the classifying gate as a true coin on the basis of the output signals from the oscillator circuits, 15, 16 17 and 18 through comparison with the respective threshold values stored in the threshold value setting circuit 25. When the inserted coin A is determined to be a true coin with respect to its shape, material and thickness and the gate member 11 is opened to accept the coin, the output circuit 26 is energized. The control circuit 24 receives binary digital signals as inputs thereto from the counter circuit 23. The counter circuit 23 is controlled by the control circuit 24 to count the oscillation frequencies of the oscillator circuits 15 to 18 to produce a binary digital signal, and the output signals of the counter circuit 23 are serially applied to the control circuit 24.

Here, it should be mentioned that, according to the teaching of the invention, the distance between the coils 8*a* and 8*b* of the coin thickness detecting sensor 8 is enlarged in response to the opening of the coin passage for rejecting the inserted coin, as is shown in FIG. 5, whereby a coin rejecting signal is derived. More specifically, in the normal case where the coin passage is closed, the oscillator circuit 17 produces an output frequency of $f_o$. However, when the coin rejecting passage is opened, resulting in the distance between the coils of the coin thickness detecting sensor 8 being increased, as in shown in FIG. 5, then the self-inductances and the mutual inductance of the coils 8*a* and 8*b* of the coin thickness sensor 8 are increased. As a consequence, the associated oscillator circuit 17 produces an output frequency $f_2$ which is lower than the frequency $f_o$. Since the oscillation frequency $f_2$ is proportional to the increase in the distance between the coils 8*a* and 8*b*, it is possible to detect the increased width of the coin passage on the basis of the difference $-\Delta f_2$ between the frequencies $f_2$ and $f_o$. Thus, the difference signal $-\Delta f_2$ produced when the width of the coin passage is increased beyond a predetermined value can be utilized as the coin rejecting signal.

In this manner, by detecting variation $-\Delta f_2$ in the oscillation frequency of the oscillator circuit 17 in which the coils 8*a* and 8*b* of the coin thickness sensor 8 are connected as the oscillation coils and by comparing with the coin rejecting threshold value set for the coin rejecting and stored in the threshold value setting circuit 25 through the control circuit 24, it is possible to control operation of the output circuit 26 reject coins with the aid of the coin rejecting signal.

Although it has been described that the coin thickness sensor 8 is utilized also as the sensor for triggering the coin rejecting operation, it will be appreciated that the coin material sensor 9 may be employed to attain a similar function.

Next, the operation of the coin selector apparatus of the above structure will be described in conjunction with discriminating operations for the coin shape, coin thickness, coin material and passage of a coin by referring to FIGS. 8 to 13.

Figure 8:
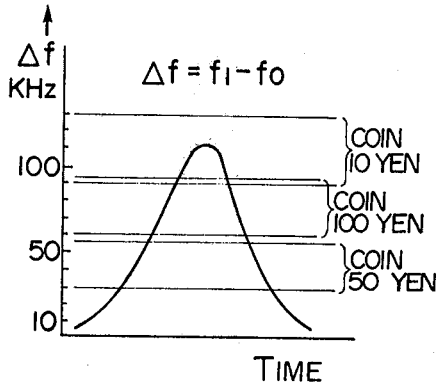
FIGS. 8 to 13 are graphs illustrating operations of the coin selector apparatus.
Figure 9:
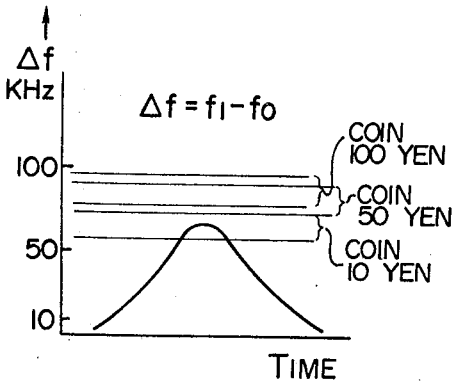
Figure 10:
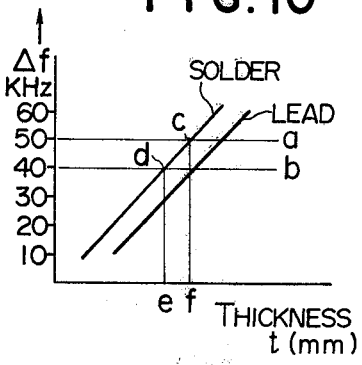

In the first place, discrimination as to the coin shape and the coin thickness will be described. When no coin A is present on the coin path, the oscillator circuits 15 and 17 produce normally the respective idle frequencies (e.g. output frequencies of 450 KHz and 750 KHz, respectively). However, when a coin A is inserted in and moves successively through the electromagnetic fields produced by the coin shape sensor 7 and the coin thickness sensor 8, each of the output oscillation frequencies from the oscillator circuits 15 and 17 will undergo corresponding variation as a function of time. The varying frequency is represented by $f_1$. Thus, for discriminations of coins with respect to their shape and thickness a respective maximum value of difference frequency $\Delta f = f_1 - f_o$ is detected as shown in FIGS. 8 and 9 and comparison is made through the control circuit 24 to determine whether the difference frequency $\Delta f$ lies within the ranges of the threshold values preset for the coin shape and the coin thickness, respectively. The ranges of the threshold values can be experimentally determined on the basis of the results of experiments made by using false and true coins and stored in the threshold value setting device 25.

Next, discrimination of the coin material will be described. As can be seen from FIG. 7, detection of the coin material and the coin thickness is effected by the oscillator circuits 16 and 17 having similar circuit configurations. In the case of discrimination with respect to coin thickness, an inserted coin A which differs from the true coin with respect to its material is determined to be an acceptable coin so far as the coin thickness gives rise to generation of the difference frequency $\Delta f$ which falls within the range of the threshold values preset for the allowable thickness as illustrated in FIG. 9. More specifically, referring to FIG. 10 which illustrates characteristically the relationship between the coin thickness and the difference frequency $\Delta f$ for coins which have the same shape and are made of different materials (e.g. solder and lead), lines a and b represent therebetween the range of the threshold values set for the coin thickness to be determined as that of the true coin. Assuming that the inserted coin is made of solder, i.e., false material, which gives rise to variation in a frequency difference $\Delta f$ represented by the curve "SOLDER" in FIG. 10, then the curve "SOLDER" will intersect the lines a and b at the points c and d, respectively, as the result of which the false coin made of solder will be determined as the authorized or true coin, so far as the thickness of the false coin is in the range of thickness e to f, a predetermined value corresponding to the threshold lines a and b for the true coins.

Figure 11:
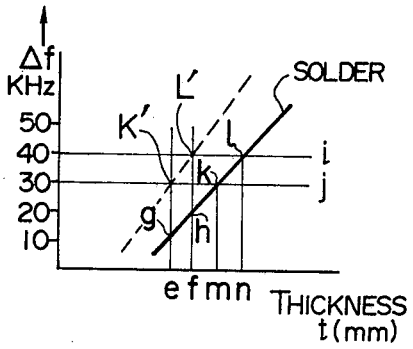

In the case of coin material discrimination in the coin selector apparatus according to the invention, a comparison to determine whether the maximum value of the difference frequency $\Delta f$ produced by an inserted coin falls within the range of predetermined threshold values is made by the control circuit 24 in a manner similar to that made in the case of the thickness discrimination. In this connection, it should however be noted that the position of the coin material sensor 9 and the oscillation frequency (about 200 KHz in a practical example) of the associated oscillator circuit 16 are made different from those for the coin thickness discrimination such that the curve representing the relationship between the coin thickness and the frequency difference $\Delta f$ has a slope different from that of the corresponding curve adopted for the coin thickness discrimination shown in FIG. 10, even when the coin is made of a same material, as is illustrated in FIG. 11 (e.g., the gradient of the FIG. 11 curve becomes slightly less steep than that of the FIG. 10 curve). Accordingly, at points e and f shown in FIG. 11 which correspond to the points e and f shown in FIG. 10, the characteristic frequency difference $\Delta f$ of solder will take values g and h, respectively. On the other hand, at points k and l at which the characteristic curve "SOLDER" intersects threshold lines j and i which define the range of the thickness values predetermined for the material of the coin to be determined as a true coin, the coin thicknesses have values m and n. Accordingly, a coin of solder which has been determined as a true coin because of having a thickness in the range of e to f in the thickness discrimination in FIG. 10 will be determined as a false coin, since the coin in question has a thickness in the range of m to n in the material discrimination. In contrast, the $\Delta f$ characteristic curve of an authorized material coin becomes the dashed curve, which intersects the threshold lines j and i at points K′ and L′ and selects the corresponding thickness range of from e to f as shown in FIG. 11. This selected range coincides with that selected for the true thickness coins in FIG. 10. In other words, according to the invention, when a coin thickness range predetermined for a true coin, e.g., the range of e to f covers both the thickness range of a coin which is detected as a true thickness coin in the thickness discrimination process and the thickness range of the coin which is also detected as a true material coin in the material discrimination process (in FIG. 11), it is determined that the coin is made of an authorized material. More specifically, when the respective thickness (or a corresponding value of $\Delta f$) of a coin in question takes place in the predetermined range of e to f in the thickness discrimination process and in the material discrimination process, it is determined that the coin is made of the authorized material.

Next, detection of the coin passage will be described. As described hereinbefore, the oscillator circuit 18 produces normally an output signal at the idle frequency $f_o$ (e.g. about 600 KHz) when no coin is present. When an inserted coin A moves progressively through the electromagnetic field produced by the coin passage sensor 10, the oscillation frequency of the oscillator circuit 18 undergoes a corresponding variation to produce an output frequency $f_1$ varying as a function of time. A difference frequency $\Delta f = f_1 - f_o$ is detected and compared with the associated threshold value stored in the threshold setting circuit 25. The time point at which the difference frequency $\Delta f$ becomes higher than the stored threshold value is detected by the control circuit 24, whereby the coin passage detection is accomplished.

Figure 12:
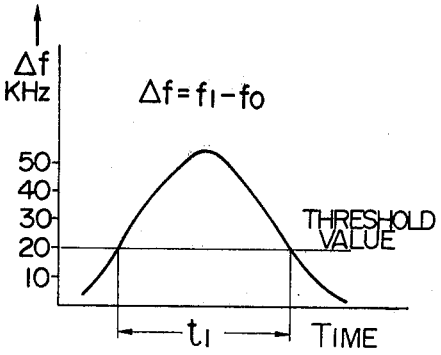

Determination as to whether a coin is introduced into the classifying section as the true coin is made in the manner described below. When a coin inserted in the coin selector has been identified as a true coin on the basis of the output signals derived from the shape sensor 7, the thickness sensor 8 and the material sensor 9, a true coin identifying signal is produced in response to which the gate member 11 of the classifying section is opened by the solenoid 12 to allow the coin to be accepted by the coin classifying section. The time span between the time point at which the gate 11 is properly actuated and the time point at which the coin passage is detected by the sensor 10 is given by a predetermined constant time $t_1$, as shown in FIG. 12.

Figure 13:
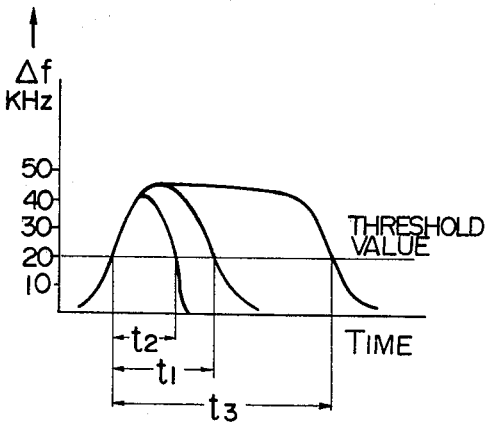

By the way, when a coin attached with a thread or the like for withdrawal thereof is inserted, the corresponding time span represented by $t_2$ in FIG. 13 will of course become shorter than the correct time span $t_1$, because the coin is withdrawn before being introduced into the coin classifying section. On the other hand, when the gate 11 is not properly actuated although the true coin identifying signal has been produced, the coin will be rejected through the return passage 14. In this case, the time elapsed $t_3$ during which the coin passes the sensor 10 is detected and is longer than $t_1$, as is illustrated in FIG. 13. In this manner, when the true coin attached with a length of thread for withdrawal or when the gate member is not properly actuated due to malfunction, no coin accepting signal is produced. Under the circumstances, the coin identified as a true coin by the sensors 7, 8 and 9 will not trigger the operation of the output circuit 26.

From the foregoing description, it will be appreciated that the main portion of the electric circuit for the coin selector according to the invention can be constituted by an inexpensive microcomputer in a simplified circuit configuration by virtue of the fact that the discrimination of coins with respect to their shape, material and thickness is carried out through similar digital techniques. Further, coin selection can be attained with an improved accuracy and reliability by virtue of the coin pass time discrimination described above. Besides, because either one of the coin thickness sensor of the coin material sensor can be made use of as a coin rejection detector, the whole circuit arrangement can be implemented inexpensively in a simplified configuration with enhanced operational stability and reliability.

What is claimed is:

1. A coin selector apparatus, comprising a coin shape detecting sensor, a coin thickness detecting sensor and a coin material detecting sensor disposed along a coin passage along which a coin thrown-in the coin selector is moved; oscillator circuits provided for detecting shape, thickness and material of the coin, respectively, each of said oscillator circuits incorporating coil means of the associated one of said sensors for producing an output frequency signal which varies in dependence on the individual coins passing by each of said associated sensors; and discriminator means for identifying the shape, thickness and the material of said coin by determining whether maximum values of variation in the output frequencies of said oscillators fall within respective predetermined ranges of threshold values preset for the shape, the thickness and materials of the coins authorized to be used, whereby the coin is determined as an authorized coin when affirmative results are obtained from all of said determinations, wherein the material of a coin is determined to be an authorized one when the range of coin thickness in which the coin is determined as the authorized one in the thickness determination coincides with the thickness range in which the coin is determined as the authorized one in the material determination, a selected one of said coin thickness sensor and said coin material sensor being so arranged that the coil gap of said selected sensor is changed in association with closing and opening of the coin passage, whereby a variation in the output frequency of the corresponding oscillator circuit is detected to produce a coin rejection signal in dependence on the magnitude of said frequency variation.

2. A coin selector apparatus comprising:

a coin path along which a coin deposited in said coin selector is moved, coin shape, coin thickness and coin material detecting sensors disposed sequentially along said path and providing a coin passage therein, each of said sensors including a coil means;

an oscillator circuit for each of said sensors, each of said oscillator circuits incorporating a corresponding one of said coil means, the output of each of said oscillator circuits having a frequency which varies in accordance with the type of coin passing the associated sensor as it traverses said coin path; and discriminator means coupled to the outputs of said oscillator circuits, said discriminator means including means for generating threshold signals each corresponding to a predetermined frequency range representing permissible values of shape, thickness and material of said coin, and means for comparing the frequency variations at the outputs of said oscillator circuits with said threshold signals to determine whether said coin falls within said permissible values, said coin having permissible values when the frequency variations at the outputs of the oscillator circuits incorporating the coil means for said coin shape, coin thickness and coin material sensors respectively are within said predetermined frequency ranges, the material of said coin being of a permissible type when the thickness of said coin measured by said coin thickness sensor coincides with the thickness of said coin as measured by said coin material sensor;

a coil means being included in one of said coin thickness and coin material sensors having a gap which is varied in accordance with the closing and opening of said coin passage, a variation in the output frequency of the corresponding oscillator current being detected to generate a coin rejection signal in accordance with the magnitude of said frequency variation.

3. A coin selector apparatus as set forth in claim 1 or 2, wherein said coin shape detecting sensor is disposed at a position at which coins having different areas overlap said sensor by substantially different amounts.

4. A coin selector apparatus as set forth in claim 1 or 2, wherein said coin thickness detecting sensor and said coin material detecting sensor are disposed at positions at which coins having different areas substantially completely overlap said sensors.

5. A coin selector apparatus as set forth in claim 1 or 2, wherein both of said oscillator circuits for detecting the coin thickness and the coin material, respectively, have identical circuit arrangements and different oscillation frequencies.

6. A coin selector apparatus as set forth in claim 2 which further comprises a coin passage detecting sensor including a coil means disposed along said coin path, said coin path having an authorized coin accepting branch and a coin rejecting branch;

a gate member for selectively connecting said coin path to either said authorized coin accepting branch or said coin rejecting branch;

coin passage oscillator circuit for said coin passage detecting sensor, said oscillator circuit including said coin passage detecting sensor coil means, the output of said oscillator circuit having a frequency which is varied in accordance with whether a coin is passing said coin passage detecting sensor, said discriminator means being further coupled to the output of said coin passage oscillator circuit and generating a threshold signal corresponding to a predetermined interval, said coin being transferred to said authorized coin accepting branch or said coin rejecting branch depending on whether the interval between detection of said coin by said oscillator circuit and the actuation of said gate member is equal to or different from said predetermined interval; and an output circuit, said output circuit being actuated when the material of which said coin is fabricated and the time of passage of said coin from said coin passage detecting sensor to said gate member are within permissible limits.

* * * * *